United States Patent [19]

Pozzobon et al.

[11] Patent Number: 4,826,098

[45] Date of Patent: May 2, 1989

[54] BRAKE, PARTICULARLY FOR THE LOCKING OF TENSIONING ELEMENTS PROVIDED IN SKI BOOTS

[75] Inventors: Alessandro Pozzobon, Paderno Di Ponzano Veneto; Roberto Gorza, Feltre, both of Italy

[73] Assignee: Nordica S.p.A., Montebelluna TV, Italy

[21] Appl. No.: 96,198

[22] Filed: Sep. 14, 1987

[30] Foreign Application Priority Data

Sep. 23, 1986 [IT] Italy ..... 59440/86[U]

[51] Int. Cl.[4] ..... A43B 05/04; A43C 11/00

[52] U.S. Cl. ..... 242/99; 36/50; 24/68 SK

[58] Field of Search ..... 242/99, 75.4, 156, 156.1; 36/50, 117; 24/68 SK, 69 SK; 154/391; 188/70 R; 192/70.15

[56] References Cited

U.S. PATENT DOCUMENTS

| | | | |
|---|---|---|---|
| 3,228,177 | 1/1966 | Coates | 188/70 R |
| 3,480,228 | 11/1969 | Ulert | 242/156 |
| 4,680,878 | 7/1987 | Pozzobon et al. | 36/117 |

*Primary Examiner*—Stuart S. Levy
*Assistant Examiner*—Steven M. du Bois
*Attorney, Agent, or Firm*—Guido Modiano; Albert Josif

[57] ABSTRACT

Brake, particularly for the locking of tensioning elements provided on ski boots, constituted by an arm eccentrically pivoted to a containment body and having a curved portion engaging the groove of a pulley adapted to wind a traction element such as a cable; an elastic means forces the arm curved portion in the groove, means being provided for the disengagement of the arm from the pulley.

10 Claims, 1 Drawing Sheet

BRAKE, PARTICULARLY FOR THE LOCKING OF TENSIONING ELEMENTS PROVIDED IN SKI BOOTS

BACKGROUND OF THE INVENTION

The present invention relates to a brake, particularly usable for the locking of tensioning elements in ski boots.

The use of locking devices is known in ski boots for the closure of the quarters or for the fastening of foot pressers or for similar functions normally required in a boot.

Such devices usually comprise a shaft or a pulley for winding traction elements, such as bands or cables, on the axis whereof are associated suitable ratchet means adapted to allow the rotation of the pulley in the direction of winding of said traction elements.

The disadvantages which can be found in such types of known devices reside in the fact that it is not always possible to regulate as precisely as required the tension of the traction element since that regulation is often discontinuous, being it related to the number of teeth with which the ratchet interacts. Furthermore, the disengagement of said ratchets or hook means, to allow the rotation of the pulley in the direction of unwinding, is difficult, since the teeth are always under tension, especially for functions requiring significant traction forces such as the closure of the quarters.

SUMMARY OF THE INVENTION

The aim of the present invention is therefore to eliminate the disadvantages described above in known types by providing a brake which allows the locking with continuity of traction elements wound on shafts or pulleys.

Within the scope of the above described aim, another important object is to achieve an optimum and safe locking in a simple and rapid manner.

Still another object is to devise a brake which associates with the preceding characteristics that of allowing the rapid and easy unlocking of the rotation of the pulley in the direction of unwinding of the cable.

Not least object is to provide a brake which is structurally compact and simple to apply.

The aim and the objects described above, as well as others which will become apparent hereinafter, are achieved by a brake, particularly for the locking of tensioning elements provided on ski boots, comprising a pulley rotatably associated to a containment body and adapted to wind a traction element, wherein it further comprises an arm, eccentrically pivoted to said body and having at least one curved section engaging the groove of said pulley by the action of an elastic element, means being provided for the disengagement of said curved section from said groove of said pulley.

BRIEF DESCRIPTION OF THE DRAWINGS

Further characteristics and advantages of the invention will become apparent from the detailed description of a particular embodiment, illustrated only by way of nonlimitative example in the accompanying drawings, wherein.

DESCRIPTION OF THE PREFERRED EMBODIMENTS

Figures 1, 2, 3, 4:
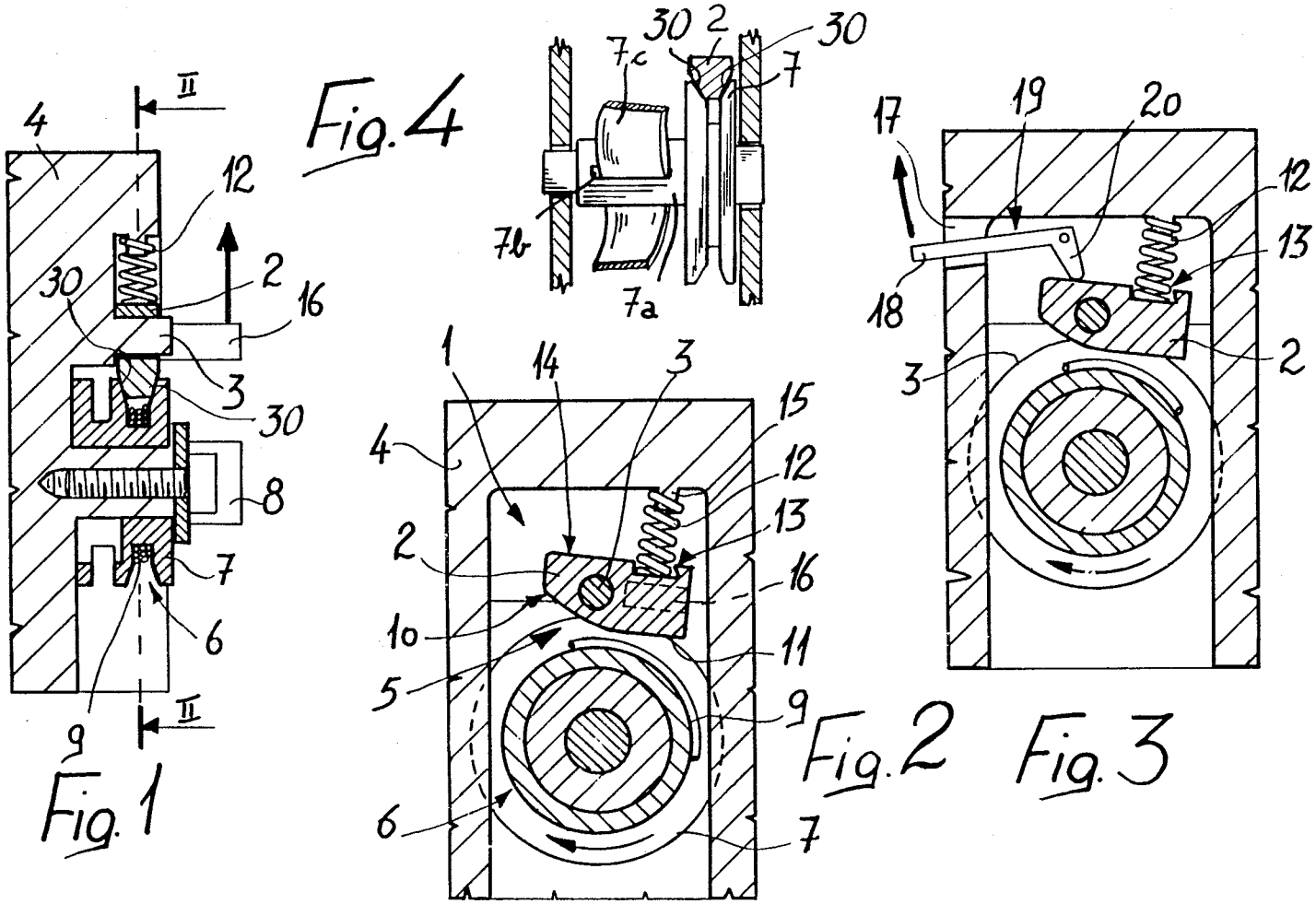
FIG. 1 is a longitudinal sectional view of a brake applied to a pulley.
FIG. 2 is a cross sectional view taken along the line II—II of FIG. 1.
FIG. 3 shows a brake according to another aspect of the invention in a view similar to that of FIG. 2.
FiG. 4 is a schematic sectional view of the brake applied to a different tensioning element.

With reference to the above described figures, the brake, generally indicated by the reference numeral 1, consists of an arm 2 pivoted to a pivot 3 which protrudes from a containment body 4 associable with a ski boot, not illustrated.

The arm 2 is pivoted eccentrically with respect to its transverse middle axis, and has a lateral curved surface 5 accommodated in the groove 6 of a pulley 7 which is rotatably associated with said containment body 4 and operatable, for example, by means of an adapted knob 8. The pulley 7 can be axially provided with a shaft *7a* having a longitudinal opening *7b* for a band *7c* accommodatable therein. Alternately a cable 9 is associable within the groove 6 and is adapted for example to fasten the quarters of the boot or a presser arranged at the foot instep or heel regions, in a per se known manner.

The lateral curved surface 5 has a first longer curved portion 10 arranged at the region of the arm whereto is hinged the pivot 3, and a second shorter approximately rectilineat portion 11 which is continuously connected with the first portion. In correspondence of the curved portion 10, the lateral external profile of the arm is tapered and defines a region with a minimal radial distance from the pivot 3.

The lateral inclined surfaces 30 of the arm 2 of the brake interact with the lateral walls of the groove 6 of the pulley 7, except from the region with minimal radial distance from the picot 3, allowing the rotation of said pulley only in the direction of winding of the traction element corresponding to that for which the peripheral edge of the pulley meets first the tapered end of the arm with curved portion 10, as indicated by the arrows in the FIGS. 2 and 3. The traction element can consist of the cable 9 or of the band *7c* which can be wound on the shaft *7a*. The cable 9 in any case does not interact with the curved section 5 of the arm 2.

In order to force the surfaces 30 into the groove 6 of the pulley 7, an elastically deformable element is provided, consisting of a cylindrical helical compression spring 12 the ends whereof are accommodated, respectively, in an adapted seat 13 provided on the planar surface 14 opposite to the surface 5 and on a lug 15 which protrudes from said containment body 4.

The seat 13 is provided proximate to the end of the arm 2 overlying the second portion 11.

Conveniently, the curved external profile of the section 10 consists of an arc of circumference with its center arranged on a plane which is perpendicular to the pivot 3 end which passes through the seat 13.

A lever 16 protrudes outside the containment body 4 transversely with respect to the arm, and the user can thereby manually impart to the arm 2 a rotation around its pivot 3.

The use of the brake 1 is therefore as follows: by imparting a clockwise rotation to the pulley 7, with reference to FIG. 2 or 3, the winding of the cable is achieved.

The locking of the pulley 7 is allowed by virtue of the friction provided between the lateral surfaces 30 of the arm 2 of the brake 1 and the lateral walls of the groove 6 of said pulley.

When the desired tension of the cable 9 (or the band 7c) is reached, and the user disengages the knob 8, the unwinding of the cable 9 is prevented by the brake's arm 2 interacting with the lateral walls of the groove 6; by wedging itself in, a locking action is achieved which is all the more powerful the greater the traction imparted to said cable.

If the user wishes to unwind the cable, it is sufficient to grip the lever 16, imparting thereto an upward motion which causes the lateral surfaces 30 to disengage from the walls of the groove when the minimal radial distance from the pivot 3 is reached. The spring 12 subsequently returns the arm 2 in contact with the pulley's groove.

If it is more convenient to provide a disengagement means of the curved section 5 from the groove laterally and not frontally with respect to the containment body 4, an opening 17 can be provided on the body 4 wherefrom projects the stem 18 of a small preferably L-shaped rod 19. The rod 19 is advantageously pivoted to the containment body 4 at the joining of its arms and arranged so that the smaller arm 20 interacts by contact with the end of the arm 2 which is opposite, with respect to the pivot 3, to the one provided with the seat 13 for the spring 12.

Also in this case the user need only impart a rotation to the small rod 19 as indicated in FIG. 3 in order to have the latter impart to the arm 2 a rotation about its own pivot 3 in the opposite direction and so as to move the surface 5 away from the base of the groove 6.

It has thus been observed that the invention achieves the intended aim and objects, a brake having been provided which allows the locking of the traction elements at the pulleys in a continuous manner, free from discontinuities, said locking being in any case optimum and safe.

The use of the brake is furthermore very easy and rapid for the user, its compact structure allowing its accommodation in the containment bodies usually employed and associated with ski boots.

Naturally the materials, as well as the dimensions of the individual components of the invention, may be any according to the specific requirements.

We claim:

1. In a device for tensioning flexible traction elements for ski boots, said device including a containment body which is rigidly connected to a ski boot and has at least one lateral opening, a pulley which has a rotation axis rigidly associated with said containment body for winding a ski boot flexible traction element, a brake for releasably locking said tensioning device comprising:

1. a braking arm pivotally attached to said containment body laterally of said pulley, said arm having a peripheral groove and a transverse pivotal axis; at least one lateral curved surface extending longitudinally of said arm and arranged to tangentially cooperate with said said groove for at least partial frictional engagement therewith;
2. spring means acting on said braking arm to normally force said lateral curved surface thereof against said groove to thereby exert a braking action thereon for preventing unwinding of said traction element;
3. disengagement means operable to bring said curved surface portion away from frictional engagement with said groove in contrast to the action of said spring means;

wherein said disengagement means comprises a small substantially L-shaped rod defining a short rod arm and a long rod arm, said L-shaped rod being pivoted to said containment body at the intersection point between said long and said short arm in such a way that said long arm extends in a substantially longitudinal direction with respect to said braking arm and protrudes outwardly from said containment body through said at least one lateral opening thereof, said short rod arm being arranged to interact with said braking arm along a lateral surface thereof opposite to said curved surface portion, whereby in operation, rotation of said long rod arm from outside of said containment body causes rotation of said braking arm against the bias of said spring means so as to reduce frictional engagement of said braking arm with said groove to thereby unlock said tensioning device and allow unwinding of said traction element.

2. A brake according to claim 1, wherein said rotation axis of said pulley and said pivotal axis of said braking arm are substantially parallel to each other, said pivotal axis being eccentrically located on said arm in a position closer to one first end thereof.

3. A brake according to claim 2, wherein said lateral curved surface of said arm comprises a first curved portion starting from said first end and a substantially rectilinear portion which is continuously connected with said curved portion and which ends at the second end of said arm.

4. A brake according to claim 3, wherein said lateral curved surface defines a pair of opposite inclined surfaces substantially complementary shaped with respect to the internal walls of said groove and so arranged to at least partially frictionally engage with said walls of said groove.

5. A brake according to claim 3, wherein said lateral curved surface has a substantially convex external profile progressively tapering said arm towards said first end thereof and reducing the radial distance of said profile from said pivotal axis to thereby correspondingly reduce the frictional engagement with said groove, whereby rotation of said pulley in a winding direction in which it first meets said curved portion of said braking arm, causes said arm to initially rotate in a first direction so as to progressively and continuously reduce the frictional engagement with said groove and to finally disengage therefrom stopping any braking action, and whereby rotation of said pulley in a unwinding direction causes said arm to rotate in a second direction so as to progressively and continuously wedge inside said groove, to thereby provide a continuous unidirectionally enhanced braking action on said tensioning device.

6. A brake according to claim 5, wherein said containment body has a lug prutruding from the internal surface thereof and said braking arm has a seat formed on the lateral surface thereof opposite to said curved portion, said spring means comprising a helical compression spring having one end engaging said lug and another end accomodated in said seat.

7. A brake according to claim 6, wherein said braking arm defines a plane perpendicular to said pivotal axis and passing through said seat, said convex profile of said curved portion consisting of an arc of circle lying in said plane.

8. A brake according to claim 1, wherein said flexible traction element of said tensioning device is a cable windable in the bottom of said groove while remaining out of contact with said braking arm.

9. A brake according to claim 1, wherein said pulley has an axial shaft with a through opening extending transversly thereto, said flexible traction element of said tensioning device comprising a flexible band passing through said transverse opening of said shaft.

10. A releasable and continuously operable brake for a tensioning device for flexible traction elements of a ski boot, said tensioning device including a containment body having a lateral passage, a winding pulley rotatably mounted upon said containment body for winding and unwinding said flexible traction element, said brake comprising a pivotal arm which is associated with said containment body laterally of said pulley and is provided with a peripheral groove and a transverse pivotal axis cloeser to one end thereof, said arm having at least one lateral curved surface proximate to said pivotal end which is frictionally engageable with said groove in a substantially tangential relationship therewith, there being provided spring means acting on said pivotal arm to normally urge said lateral curved surface thereof against the bottom of said groove, there being further provided operative means acting on said pivotal arm and biasing said spring means for disengaging said lateral curved surface from said groove, wherein said lateral curved surface is so formed no taper said arm towards said pivotal end thereof and to reduce the distance of said curved surface from said pivotal axis up to a minimal value thereby progressively and continuously reducing and finally interrupting said frictional engagement of said arm with said groove and wherein said disengagement means comprises a substantially L-shaped lever which has a short leg and a long leg and is pivoted to said containment body at the intersection point between said long and said short legs, said long leg extending in a substantially parallel direction to said pivoting arm and protruding outwardly from said containment body through said lateral passage thereof, said short rod leg extending substantially transversly to said arm to interact with a lateral surface of said arm opposite to said curved surface portion, whereby in operation, rotation of said long leg from outside of said containment body causes rotation of said pivotal arm against the bias of said spring means so as to reduce frictional engagement thereof with said groove to thereby unlock said tensioning device and to allow unwinding of said traction element.

* * * * *